US005357663A

United States Patent [19]

Morioka et al.

[11] Patent Number: 5,357,663

[45] Date of Patent: Oct. 25, 1994

[54] SLIDE FASTENER COUPLING ELEMENT FORMING APPARATUS

[75] Inventors: Koitsu Morioka; Tsunetaka Aoki, both of Toyama, Japan

[73] Assignee: Yoshida Kogyo K.K., Tokyo, Japan

[21] Appl. No.: 81,106

[22] Filed: Jun. 25, 1993

[30] Foreign Application Priority Data

Jul. 6, 1992 [JP] Japan ..... 4-178286

[51] Int. Cl.[5] ..... B21D 53/56

[52] U.S. Cl. ..... 29/34 A; 29/33.2; 29/410; 29/769; 72/427

[58] Field of Search ..... 29/33.2, 34 A, 769, 29/766, 410, 408, 409; 72/427, 422

[56] References Cited

U.S. PATENT DOCUMENTS

| | | | |
|---|---|---|---|
| 2,473,623 | 6/1949 | Voity | 29/33.2 |
| 2,596,888 | 5/1952 | Coan | 29/410 |
| 2,744,560 | 5/1952 | Johns et al. | 29/33.2 |
| 3,490,133 | 1/1970 | Glindmeyer et al. | 29/33.2 X |
| 4,404,722 | 9/1983 | Shimai | 29/33.2 |
| 4,432,126 | 2/1984 | Sugahara | 29/769 X |
| 4,550,477 | 11/1985 | Iai | 29/34 A X |
| 4,809,533 | 3/1989 | Owens | 72/422 X |

FOREIGN PATENT DOCUMENTS

| | | | |
|---|---|---|---|
| 467126 | 8/1950 | Canada | 29/410 |
| 658654 | 2/1963 | Canada | 29/410 |
| 0028358 | 5/1981 | European Pat. Off. . | |
| 0048807 | 4/1982 | European Pat. Off. . | |
| 48969 | 4/1982 | European Pat. Off. | 29/33.2 |
| 0048969 | 4/1982 | European Pat. Off. . | |
| 55-36026 | 3/1980 | Japan | 72/427 |

*Primary Examiner*—William Briggs
*Attorney, Agent, or Firm*—Hill, Steadman & Simpson

[57] ABSTRACT

In a slide fastener coupling element forming apparatus, a blank wire of a generally Y-shape cross section intermittently supplied at a predetermined pitch is cut off into pieces of a predetermined thickness by a fixed cutting punch and a reciprocating cutting die, and then a bulge for the head portion of a coupling element is formed by a forming die and a forming punch movable upwardly and downwardly to coact with the forming die. The forming die is located to be connected with the forward end in the stroke direction of the cutting die, and the forming punch is located upwardly of the bulge forming station. Then the opposite leg portions of a coupling element are pushed out of the mold of the forming die by a vertically movable ejector pin located under the leg portions on the forming die to discharge the formed coupling element from the forming die.

8 Claims, 5 Drawing Sheets

SLIDE FASTENER COUPLING ELEMENT FORMING APPARATUS

BACKGROUND OF THE INVENTION

1. Field of the Invention

This invention relates to an apparatus for successively forming slide fastener coupling elements by transversely cutting a blank wire of a generally Y-shape cross section, and more particularly to a slide fastener coupling element forming apparatus equipped with a coupling element discharging unit for discharging a coupling element, which has been formed and is left stuck on a bulge forming die, from the bulge forming die reliably.

2. Description of the Related Art

Conventional slide fastener coupling element forming methods of the described type are chiefly divided into two groups: one in which generally Y-shape coupling elements are formed by successively punching a continuous length of flat belt-shape metal-plate and, at the same time, bulges for successive coupling heads are formed one at a time (the resulting coupling elements will be hereinafter called "metal-plate coupling elements"); and the other in which individual coupling element blanks are obtained by threading a continuous length of blank wire through a plurality of forging rollers to shape it into a generally Y shape in cross section and then by successively cutting it into slices of a predetermined thickness using a coacting cutting punch and die, whereupon a bulge is formed at the individual coupling head of the coupling element using by a coacting bulge forming punch and die (the resulting coupling elements will be hereinafter called "wire coupling elements"). The former conventional method is exemplified by Japanese Utility Model Publication No. Sho 62-16886, and the latter conventional method is exemplified by Japanese Patent Publication No. Sho 59-27667. Subsequently, the coupling elements obtained by either conventional method are individually collected loose, or are successively attached to a fastener tape on the same apparatus.

However, since they are punched by a press or cut, either the metal-plate coupling elements plate or the wire coupling elements would be not smooth at cut surfaces and hence have to be ground. Preferably the resulting coupling elements are provided with surface treatment, such as plating, in an effort to give a high-quality look.

In the method in which the freshly formed coupling elements are attached directly to a fastener tape, plating takes place after they have been attached. This plating over the coupling elements on the insulating fastener tape could be possible by giving improvement but would be very difficult to realize in view of the high cost of production and for the complicated apparatus structure. It is also difficult to polish the leg portions of the coupling elements.

In an effort to obtain a quality product, it has been a common practice to collect the formed coupling elements in loose and then to provide over the coupling elements with a surface treatment such as polishing or plating, instead of attaching the coupling elements to the fastener tape immediately after having been formed. After the surface treatment, the coupling elements are conveyed to a slide faster manufacturing apparatus where the coupling elements are successively mounted on and along one longitudinal edge of the fastener tape at a predetermined pitch as the V-shape leg portions of the individual coupling elements are clenched.

In forming the coupling elements from a metal plate, though it is possible to freely design the coupling elements in a best shape required to be clenched on the fastener tape and in such a shape as not to obstruct the movement of a slider of the slide fastener, the rate of the non-punched-out section to punched-out section would be fairly large for a desired shape, causing a large amount of loss of material more than the amount of products. Yet if this loss could be reduced to a minimum, it would be difficult to realize the best shape.

Further, since their cut surfaces appear on the surface of the products, the metal-plate coupling elements would make a poor show, depending on the sharpness of the press. Therefore, to obtain a quality product, the metal-plate coupling elements thus obtained are polished and then plated. Besides, since a bulge for the head portion of the coupling element is formed by the press simultaneously with cutting by the press, the bulge is apt to be misshaped to give a great influence on the sliding resistance of a slider.

In forming the coupling elements from a blank wire, since the wire coupling elements formed in a generally Y-shape cross section is successively cut into slices of a predetermined thickness perpendicularly to the blank wire, it is possible to achieve a very high rate of production with no loss of material. This method is therefore most suitable for forming coupling elements.

However, in collecting the wire coupling elements from the forming die after they have been obtained by cutting the wire of a generally Y-shape cross section into slices at a predetermined pitch and forming a bulge for a coupling head portion of the coupling element, the individual coupling element will often stay on the forming die as it is left stuck thereon so that the coupling elements cannot be reliably collected up, thus making it impossible to perform the next forming, or giving damage to peripheral equipments, which therefore have to stop their operation.

SUMMARY OF THE INVENTION

An object of this invention is to provide an apparatus, for forming slide fastener coupling elements from a blank wire, which includes a coupling element ejecting unit for reliably removing and collecting a coupling element from a forming die even when the coupling element is left stuck thereon and staying on the forming die.

According to the invention, there is provided an apparatus for successively forming slide fastener coupling elements, comprising supplying means for supplying a blank wire of a generally Y-shape cross section intermittently at a predetermined pitch, a cutting die having a wire insertion hole for the passage of the blank wire and movable back and forth in a direction of cutting the blank wire, a bulge forming die connected with a forward end in the stroke direction of the cutting die for forming a bulge for a coupling head portion of the coupling element, a cutting punch fixedly mounted on a frame and slidable on an upper surface of the cutting die, and a bulge forming punch situated upwardly of the bulge forming die and vertically movable toward and away from the bulge forming die, wherein the apparatus further includes removing means for ejecting the freshly formed coupling element from the bulge forming die, the removing means being adapted to be situated downwardly of the freshly formed coupling element for pushing the coupling element upwardly.

Preferably, the apparatus further includes air jetting means, adapted to be located downwardly of the freshly formed coupling element on the bulge forming die in parallel to the removing means, for jetting pressurized air over the lower surface of the coupling element, and discharging means adapted to be located upwardly of the freshly formed coupling element for discharging the ejected coupling element out of the apparatus. Further, the removing means is an ejector pin vertically movable through the bulge forming die, and the ejector pin has a tip end set up to be vertically aligned with roots of generally V-shape leg portions of the coupling element, and the ejector pin is operatively connected with the cutting die for vertical movement in timed relation thereto.

In this apparatus, while individual moving parts are actuated to perform the following operations in timed relation with one another, successive coupling elements are ejected with reliableness as they are formed one after another.

For example, while a first ram makes a forward stroke, a blank wire is conveyed longitudinally. At the end of the forward stroke of the first ram, the blank wire is stopped projecting from the cutting die by a predetermined length, i.e., a predetermined thickness of the coupling element. Then as the first ram makes a backward stroke, the projected portion of the blank wire is cut off by the cutting punch, and this predetermined length of the blank wire is then moved from the cutting die to the forming die.

Next, at the end of the backward stroke of the first ram, the forming punch is lowered together with the pressure pad to form a bulge for a coupling head portion of the coupling element on the forming die.

As it restarts moving forwardly, the first ram actuates the removing means via a third ram operable in response to the movement of the first ram. Specifically, the ejector pin is moved upwardly to project from the upper surface of the forming die to push the formed coupling element upwardly.

The individual coupling element removed from the forming die is blown up away by, for example, air pressure and is then discharged out of the forming apparatus via a coupling-element catching pipe situated upwardly of the forming die. The discharged coupling elements are collected by a collecting unit outside the forming apparatus, and are then provided with a finishing treatment such as plating. Then the finished coupling elements are conveyed to a mounting station where they are mounted on and along one longitudinal edge of the fastener tape at a predetermined pitch by clenching in the usual manner.

DETAILED DESCRIPTION

A preferred embodiment of this invention will now be described in detail with reference to the accompanying drawings.

The most significant feature of this invention is that the invention employs an removing means for reliably removing a coupling element from a forming die after the coupling element has been formed by cutting a blank wire of a generally Y-shape cross section and forming a bulge for a coupling head portion of the coupling element, as described above.

The construction of this invention except the removing means may be of the ordinary type disclosed in, for example, Japanese Patent Publications Nos. Sho 59-42903 and Sho 59-51813. Therefore, the details of the construction other than the removing means are omitted here for clarity, and the following description concentrates on the details of the removing means and includes only a brief explanation of the remaining construction.

Figure 1:
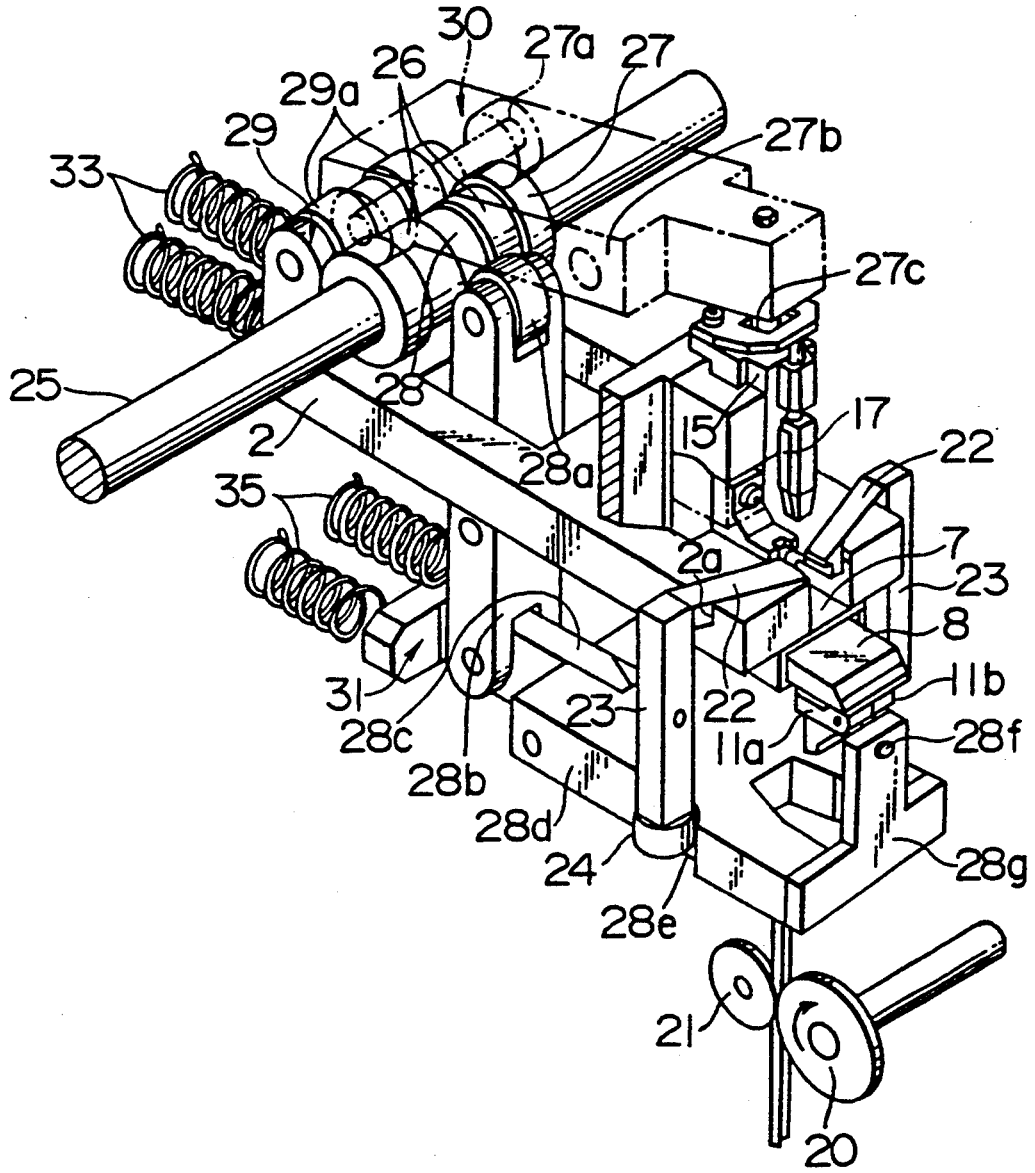
FIG. 1 is a fragmentary perspective view showing the main part of a coupling element forming apparatus according to a typical embodiment of this invention.
Figure 2:
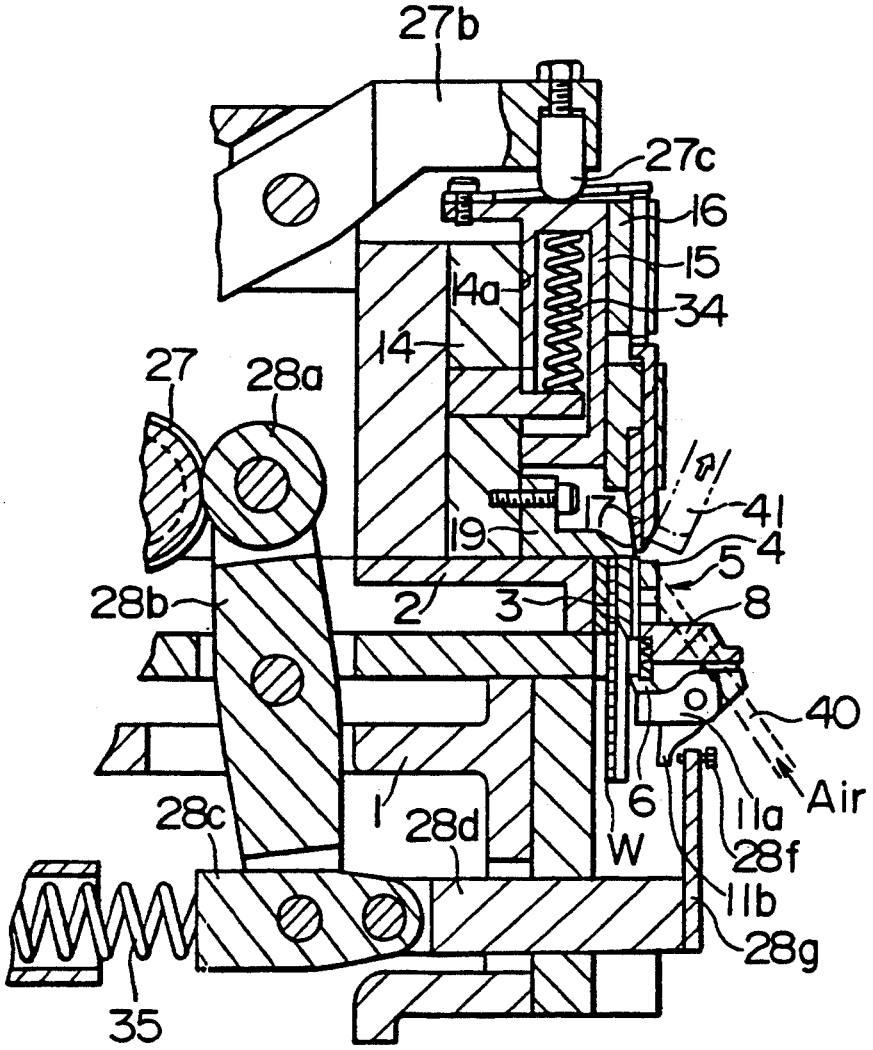
FIG. 2 is a vertical cross-sectional view showing the main part of the apparatus of FIG. 1.
Figure 3:
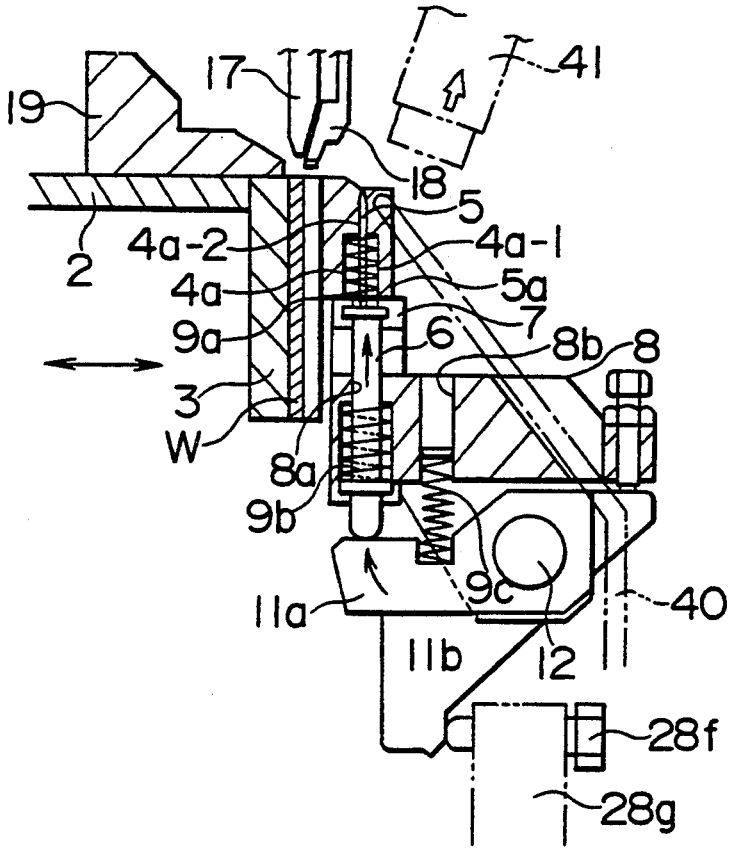
FIG. 3 is an enlarged, fragmentary cross-sectional view showing a coupling element discharging unit, which constitutes the characterizing part of the invention.

FIGS. 1 through 3 show the main structure of a slide fastener coupling element forming apparatus embodying this invention. As shown in FIGS. 1 through 3, a first ram 2 is horizontally reciprocatingly movably mounted on a frame 1. A cutting die 3 is connected with the forward end of the first ram 2, having a wire insertion hole for the passage of a blank wire W having a Y-shape cross section. Connected to the first ram 2 contiguously to the cutting die 3 is a forming die 4 forming a bulge for a coupling head portion of the coupling element E.

On the forming die 4, as shown on an enlarged scale in FIG. 3, a pair of ejector pins 5 as a typical example of the removing means is mounted. The two ejector pins 5 have a pair of upper ends locatable near the roots of V-shape leg portions of the coupling element E and an enlarged lower end 5*a*. The two ejector pins 5 are threaded through a pair of ejector-pin insertion holes 4*a* extending vertically through the forming die 4 and are adapted to be pushed upwardly by a pusher pin 6 having an upper end contacting the enlarged lower end 5*a* and normally downwardly urged. A bracket 7 is mounted on the lower surface of the forming die 4 perpendicularly thereto, and a horizontal block 8 is fixedly connected at one end to the lower portion of the bracket 7. The ejector-pin insertion hole 4*a* is divided into upper and lower halves: the lower half is a spring hole 4*a*-1 accommodating a first compression spring 9*a*, and the upper half is a pin slide hole 4*a*-2 coaxially communicating with the spring hole 4*a*-1 and slidably receiving the ejector pin 5.

Confronting the ejector-pin insertion hole 4*a*, the horizontal block 8 has a pusher-pin insertion hole 8*a* accommodating a second compression spring 9*b*, which downwardly urges the pusher pin 6, and receiving the pusher pin 6. On the side of the pusher-pin insertion hole 8*a*, the horizontal block 8 also has a spring support hole 8*b* supporting the upper end of a third compression spring 9*c*. On the horizontal block 8 at its end opposite to the pusher insertion hole 8*a*, a stop bolt 10 is mounted, the downwardly projected length of which is adjustable.

On the bracket 7 extending downwardly of the horizontal block 8, first and second levers 11*a*, 11*b* are pivotally mounted on a common pivot pin 12 for coactive pivotal movement. One end of the second lever 11*b* is in contact with the lower end of the stop bolt 10, and the lower end of the third compression spring 9*c* is supported by the first lever 11*a*, the free end of which is in contact with the lower end of the pusher pin 6.

A ram guide 14 is situated upwardly of the front part of the first ram 2 and has a guide groove 14*a* in which a second ram 15 is vertically movably received in timed relation with the horizontal reciprocating movement of the first ram 2. Attached to the front surface of the second ram 15 via a punch holder 16 are a forming punch 17 for forming a bulge for the head portion of the coupling element E and a pressure pad 18 for pressing the opposite leg portions of the coupling element E while the bulge is being formed. Further, a cutting punch 19 is fixed to the lower end of the ram guide 14 so as to frictionally contact the upper surface of the first ram 2. Downwardly of a wire insertion hole of the cutting die 3, a feed roller 20 and a guide roller 21 are situated for intermittently supplying the blank wire W upwards at a pitch corresponding to the thickness of the coupling element E.

In this embodiment, a pair of pre-clenching hammers 22 are situated at opposite sides of the forming punch 17 and are slidably received in a hammer sliding groove 2*a* in the upper surface of the first ram 2 so as to be movable toward and away from each other. The pre-clenching hammers 22 force the leg portions of a coupling element inwardly from opposite sides to define a predetermined interleg space. The interleg space to be set up by this pre-clenching is such that no crack would occur on the treated surface of the individual coupling element E by clenching when the coupling element E is mounted on a fastener tape after provided with surface treatment such as plating.

The pre-clenching hammers 22 are attached to the upper end of an actuator lever 23 at a substantially right angle, there being a cam receiver 24 at the lower end of the actuator lever 23. The central portion of the actuator lever 23 is pivotally attached to the frame 1, and the actuator lever 23 is pivotally movable about the central portion in such a direction as to cross the first ram 2 at a predetermined angle, thus causing the pair of pre-clenching hammers 22 to slide toward and away from each other in the hammer sliding groove 2*a*.

The foregoing moving parts are actuated by a plurality of cams, such as a first-ram drive cam 26, a forming-punch actuation cam 27, an ejector-pin actuation and pre-clenching-hammer drive cam 28 and a non-illustrated wire supply cam, and a plurality of cam followers 29, 30, 31 connected to the respective cams. All of the cams are mounted on a drive output shaft 25 situated on the back side of the first ram 2.

In the cam follower mechanism 29 associated with the first ram 2, a roller 29*a* resting on the first-ram drive cam 26 pivotally mounted on the back part of the first ram 2 is normally urged forwardly by a compression spring 33. As the cam 26 moves angularly, the first ram 2 stops for a predetermined time at each of predetermined forward and backward ends of the stroke.

The cam follower mechanism 30 for the forming punch 17 includes a roller 27*a* resting on the forming-punch actuation cam 27, a lever 27*b* pivotally connected at one end to the roller 27*a* and at its central portion to the frame, a pin 27*c* attached to the other end of the lever 27*b* and contacting the head of the second ram 15, and a non-illustrated compression spring for returning the lever 27*b* to its original position. Inside the second ram 15, there is mounted a compression spring 34 urging the second ram 15 upwardly; as the lever 27*b* is pivotally moved by the cam 27, the second ram 15 is lowered to return to its original position under the resilience of the compression spring 34.

The cam follower mechanism 31 for the ejector pin 5 and the pre-clenching hammer 22 includes a roller 28*a* resting on the cam 28, a downwardly extending lever 28*b* pivotally connected at one end to the roller 28*a* and at its central portion to the frame 1, a link 28*c* pivotally connected at its central portion to the other end of the lever 28*b*, a third ram 28*d* pivotally connected at its back portion to the front end portion of the link 28*c*, the actuator lever 23 supporting on its upper portion a pre-clenching hammer 22 and pivotally connected at its central portion to the frame, and a compression spring 35 mounted on the back end of the link 28*c*. The front end portion of the third ram 28*d* has an outwardly divergent cam surface 28*e*, whom the cam receiver 24 formed on the lower end of the actuator lever 23 is in contact with. As the third ram 28*d* is moved backwardly, the cam receiver 24 contacting the cam surface 28*e* causes the actuator lever 23 to pivotally move to actuate the pre-clenching hammer 22. By modifying the cam receiver 24 or the cam surface 28*e*, it is possible to change the actuation limit of the pre-clenching hammer 22.

On the forward end of the third ram 28*d*, a pusher-pin actuator 28*g* having on its upper end a horizontal adjusting screw 28*f* is mounted, and the forward end of the adjusting screw 28*f* is contactable with the lower end of the second lever 11*b* attached to the bracket 7. In FIG. 2, the first ram 2 is located at the backward end of the stroke and the third ram 28*d* is located at the forward end of the stroke, at which time the forward end of the adjusting screw 28*f* is out of contact with the lower end of the second lever 11*b*.

Next, as the first ram 2 starts moving backwardly, the blank wire W is cut off by the cutting punch 19. Still when the coupling element is received in the mold of the forming die 4 at the backward end of its stroke, the forward end of the adjusting screw 28*f* is yet out of contact with the lower end of the second lever 11*b*. Then, the first ram 2 starts moving forwardly after the forming punch 17 is actuated to form a bulge for the head portion of a coupling element. This forward movement of the first ram 2 causes the lower end of the second lever 11*b* to come into contact with the forward end of the adjusting screw 28*f* to push this screw 28*f* via the pusher pin actuator 28*g* so that the first lever 11*a* with the second lever 11*b* is angularly moved in the direction indicated by an arrow in FIG. 3 to push the pusher pin 6 upwardly. The pusher pin 6 in turn pushes, by its upper end, the pair of ejector pins 5 into the mold of the forming die 4. FIG. 3 shows the adjusting screw 28*f* at the moment of coming into contact with the second lever 11*b*.

Subsequently, the opposite leg portions of the coupling element left on the forming die 4 are reliably pushed away upwardly by the pair of ejector pins 5.

A ratchet reciprocatingly driven by, for example, a non-illustrated cam causes the feed roller 20 via a non-illustrated ratchet wheel to intermittently angularly move only in one direction at a predtermined pitch, thus intermittently supplying the blank wire W in cooperation with the guide roller 21.

In this apparatus, while individual moving parts are actuated to perform the following operations in timed relation with one another, successive coupling elements are ejected with reliableness as they are formed one after another. FIGS. 4 through 8 shows a series of steps of the coupling element forming method according to this invention.

Figure 4A:
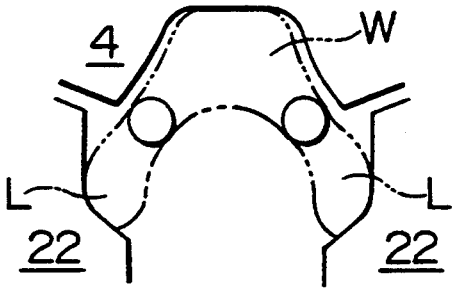
FIGS. 4*a* and 4*b* show the operation and position of the apparatus when cutting a blank wire.
Figure 4B:
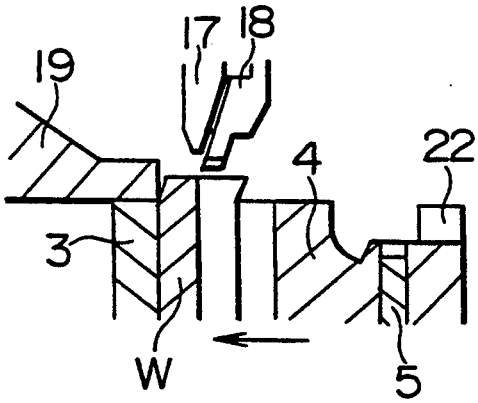

In FIG. 4(*a*), the cut coupling element E is not yet received in the mold of the forming die 4. In FIG. 4(*b*), at the end of forward stroke of the first ram 2, the supplying of the blank wire W is terminated and a predetermined length of the blank wire W projected from the cutting die 3 is cut off. In FIG. 4(*b*), the first ram 2 starts moving backwardly and the projected part of the blank wire W is cut off by the cutting punch 19, whereupon at the end of backward stroke of the first ram 2, the coupling element E is moved from the cutting die 3 into the mold of the forming die 4 in the position in FIG. 4(*a*). At that time, since the cam receiver 24 is not affected by the action of the cam surface 28*e* though with the third ram 28*d* situated slightly backward, the pre-clenching hammer 22 is not activated and merely supports the leg portion L of the coupling element E from opposite sides as shown in FIG. 5(*a*).

Figure 5A:
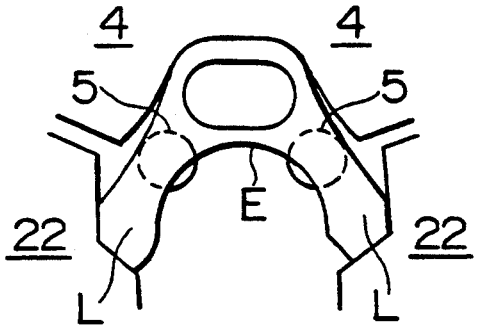
FIGS. 5*a* and 5*b* show the operation of the apparatus when forming a head portion of the coupling element.
Figure 5B:
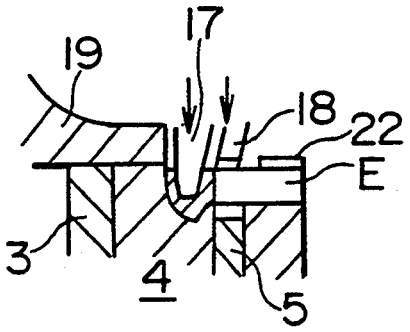

Next, at the end of backward stroke of the first ram 2, as shown in FIG. 5(*b*), the forming punch 17 with the pressure pad 18 is lowered to form a bulge for the coupling head portion C. At that time, the third ram 28*d* stops moving and the pre-clenching hammer 22 is still kept stopped, thus restricting the horizontal movement of the coupling element E. Further, the forward end of the adjusting screw 28*f* is not in contact with the lower end of the second lever 11*b*, and the pair of ejector pins 5 are fully retracted in the pin insertion hole 4*a* of the forming die 4, with no part projecting into the mold of the forming die 4, as shown in FIG. 5(*b*).

Figure 6:
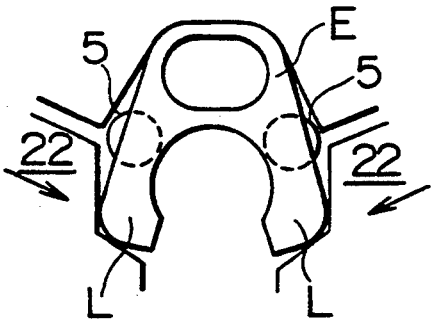
FIG. 6 shows the operation of the apparatus when pre-clenching opposite leg portions of the coupling element by a hammer.
Figure 7:
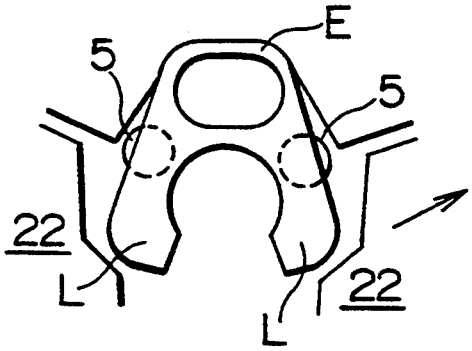
FIG. 7 shows the operation of the apparatus when releasing the pre-clenching.

Upon termination of forming the bulge for the head portion, as shown in FIG. 6, the third ram 28*d* starts moving backwardly, and the pre-clenching hammer 22 starts pre-clenching the opposite leg portions L of the coupling element E in such a direction that the interleg space is reduced to a predetermined amount. This pre-clenching terminates before the first ram 2 arrives at the forward end of stroke, and the third ram 28*d* starts moving forwardly before the first ram 2 arrives at the forward end of stroke. As a result, the pre-clenching hammer 22 is moved backwardly to release the leg portions, as shown in FIG. 7.

Figure 8:
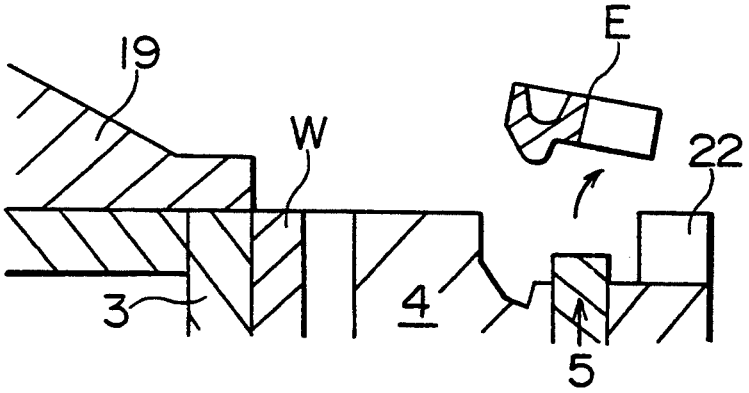
FIG. 8 is a vertical cross-sectional view showing the operation of the apparatus when discharging the coupling element, which constitutes the characterizing part of the invention.

At that time, the first ram 2 is yet moving forwardly, and the second lever 11*b* is in contact with the adjusting screw 28*f* on the forward end of the first ram 2 to angularly move in the direction as indicated by an arrow in FIG. 3 as pushed by the adjusting screw 28*f*. At the same time, the first lever 11*a* also is angularly moved in the same direction to push the pusher pin 6 upwardly against the bias of the compression springs 9*a*, 9*b*, 9*c* to cause the ejector pin 5 to project from the upper surface of the forming die 4, thus pushing the coupling element E away upwardly, as shown in FIG. 8.

The individual coupling element removed from the forming die 4 is discharged out of the forming apparatus by a suitable means. The discharged coupling elements are collected by a collecting unit outside the forming apparatus, and are then provided with a finishing treatment such as plating. Then the finished coupling elements E are conveyed to a mounting station where they are mounted on and along one longitudinal edge of the fastener tape at a predetermined pitch by clenching in the usual manner.

Phantom lines in FIGS. 2 and 3 indicate a preferred embodiment for improving the discharge of the formed coupling elements E. A pressurized air jetting pipe 40 is fixed to the frame 1, having an air jetting opening located centrally in front of the pair of ejector pins 5. Situated upwardly of the jetting pipe 40 is a coupling-element catching pipe 41. The coupling-element catching pipe 41 is only connected to a non-illustrated collecting unit situated outside the apparatus, using no special means such as suction. Of course, the coupling-element catching pipe 41 may be equipped with a positive suction means.

According to this embodiment, since air pressurized at a predetermined value is normally jetted to the lower surface of the coupling element E, for which a bulge has been formed as described above, from the jetting pipe 40, the jetted air pressure acts on the coupling element E pushed out by the ejector pin 5, thus blowing away the coupling element E upwardly to the coupling-element catching pipe 41. Thus the blown coupling element reaches the coupling-element catching pipe 41 through which it is collected into a non-illustrated collecting unit.

In the foregoing embodiments, the first ram 2 is moved forwardly by the cam 26 and backwardly by a return spring 29*a*; however, the higher the driving speed, the more the return spring has to become stronger. In an alternative form, therefore, two first-ram drive cams may be used, and the first ram is equipped with two rollers resting on the respective first-ram drive cams in such manner that no gap will be created between each cam and the associated roller, irrespective of the angular position of the cam. With this alternative arrangement, since these two rollers are in contact with the respective independent cams, it is possible to freely select allocation of motion-stop curve and timing for high-speed performance, keeping the condition that there will be created no gap between the ram and roller irrespective of any angular position of the cam.

This invention should by no means be limited to the foregoing embodiments, and various modifications may be suggested.

As is apparent from the foregoing description, according to this invention, partly since a coupling-element-of-wire forming concept giving a high rate of production is adopted, and partly since there is additionally provided a mechanical means for positively discharging the formed coupling element, it is possible to surely remove the coupling element from the forming die even if the coupling element has been left on the forming die as being stuck while a bulge is being formed, thus enabling the apparatus to be operated continuously for a long time.

What is claimed is:

1. An apparatus for successively forming slide fastener coupling elements, comprising supplying means for supplying a blank wire of a generally Y-shape cross section intermittently at a predetermined pitch, a cutting die having an insertion hole for the passage of the blank wire W and movable back and forth in a direction of cutting the blank wire, a bulge forming die connected with a forward end in the stroke direction of said cutting die for forming a bulge for a coupling head portion of the coupling element, a cutting punch fixedly mounted on a frame and slidable on an upper surface of said cutting die, and a bulge forming punch situated upwardly of said bulge forming die and vertically movable toward and away from said bulge forming die, wherein said apparatus further includes removing means for ejecting the freshly formed coupling element from said bulge forming die, said removing means being adapted to be situated downwardly of the freshly formed coupling element for pushing the coupling element upwardly.

2. A slide fastener coupling element forming apparatus according to claim 1, wherein said apparatus further includes air jetting means, adapted to be located downwardly of the freshly formed coupling element on said bulge forming die in parallel to said removing means, for jetting pressurized air over the lower surface of the coupling element, and discharging means adapted to be located upwardly of the freshly formed coupling element for discharging the ejected coupling element out of said apparatus.

3. A slide fastener coupling element forming apparatus according to claim 1, wherein said removing means is an ejector pin vertically movable through said bulge forming die.

4. A slide fastener coupling element forming apparatus according to claim 2, wherein said removing means is an ejector pin vertically movable through said bulge forming die.

5. A slide fastener coupling element forming apparatus according to claim 3, wherein said ejector pin has a tip end set up to be vertically aligned with roots of generally V-shape leg portions of the coupling element.

6. A slide fastener coupling element forming apparatus according to claim 4, wherein said ejector pin has a tip end set up to be vertically aligned with roots of generally V-shape leg portions of the coupling element.

7. A slide fastener coupling element forming apparatus according to claim 3, wherein said ejector pin is operatively connected with said cutting die for vertical movement in timed relation thereto.

8. A slide fastener coupling element forming apparatus according to claim 4, wherein said ejector pin is operatively connected with said cutting die for vertical movement in timed relation thereto.

* * * * *